US010485294B2

(12) United States Patent
Schneider

(10) Patent No.: US 10,485,294 B2
(45) Date of Patent: Nov. 26, 2019

(54) SOLE STRUCTURE FOR ARTICLE OF FOOTWEAR HAVING A NONLINEAR BENDING STIFFNESS

(71) Applicant: NIKE, Inc., Beaverton, OR (US)

(72) Inventor: Summer L. Schneider, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 148 days.

(21) Appl. No.: 15/601,397

(22) Filed: May 22, 2017

(65) Prior Publication Data

US 2017/0340055 A1 Nov. 30, 2017

Related U.S. Application Data

(60) Provisional application No. 62/343,427, filed on May 31, 2016.

(51) Int. Cl.
*A43B 13/14* (2006.01)
*A43B 13/18* (2006.01)

(52) U.S. Cl.
CPC ..... *A43B 13/141* (2013.01); *A43B 13/184* (2013.01)

(58) Field of Classification Search
CPC ..... A43B 13/141; A43B 13/184; A43B 13/22; A43B 13/223; A43B 13/226; A43B 13/18; A43B 13/181; A43B 13/14; A43B 13/24; A43B 13/41; A43B 13/16; A43B 5/02; A43C 15/02; A43C 15/10; A43C 15/16; A43C 15/161; A43C 15/162; A43C 15/168
USPC ..... 36/102, 134, 25 R, 59 R, 29 D, 31
See application file for complete search history.

(56) References Cited

U.S. PATENT DOCUMENTS

| | | | | |
|---|---|---|---|---|
| 634,588 | A | 10/1899 | Roche | |
| 1,964,406 | A | 6/1934 | Pellkofer | |
| 2,072,785 | A * | 3/1937 | Wulff | A43B 3/128 36/11.5 |
| 2,342,188 | A | 2/1944 | Ghetz et al. | |
| 2,342,466 | A * | 2/1944 | Gordon | A43B 23/22 36/76 R |
| 2,364,134 | A | 12/1944 | Dow et al. | |
| 2,379,139 | A | 6/1945 | Flink | |
| 2,413,545 | A | 12/1946 | Cordi | |
| 2,470,200 | A * | 5/1949 | Wallach | A43B 13/08 36/1 |

(Continued)

FOREIGN PATENT DOCUMENTS

| | | | |
|---|---|---|---|
| DE | 315919 | C | 11/1919 |
| DE | 202007000831 | U1 | 5/2007 |

(Continued)

*Primary Examiner* — Jameson D Collier
*Assistant Examiner* — Heather N Mangine
(74) *Attorney, Agent, or Firm* — Quinn IP Law

(57) ABSTRACT

A sole structure for an article of footwear comprises a sole plate, a plurality of traction elements protruding from the sole plate, and a tension member extending through at least some of the plurality of traction elements. The tension member can move through at least some of the plurality of traction elements during dorsiflexion of the sole structure in a first flexion range. The tension member interferes with at least some of the plurality of traction elements during dorsiflexion of the sole structure in a second flexion range, which is greater than the first flexion range.

23 Claims, 6 Drawing Sheets

(56) References Cited

U.S. PATENT DOCUMENTS 2,478,664 A 8/1949 Morrow et al.
2,537,123 A * 1/1951 Dowling, Sr. ..... A43C 15/10 36/132
2,640,283 A 6/1953 McCord
2,922,235 A * 1/1960 Meltzer ..... A43B 13/08 36/13
3,039,207 A 6/1962 Lincors
3,782,011 A * 1/1974 Fisher ..... A43C 15/161 36/128
4,026,045 A * 5/1977 Druss ..... A43B 5/0417 36/100
4,255,877 A 3/1981 Bowerman
4,391,048 A * 7/1983 Lutz ..... A43B 1/0036 36/28
4,476,638 A 10/1984 Quacquarini et al.
4,573,457 A * 3/1986 Parks ..... A61F 5/0127 36/102
4,779,361 A 10/1988 Kinsaul
4,839,972 A 6/1989 Pack et al.
4,920,665 A 5/1990 Pack et al.
4,936,028 A * 6/1990 Posacki ..... A43B 13/36 36/15
4,941,273 A * 7/1990 Gross ..... A43B 3/00 36/105
5,243,776 A * 9/1993 Zelinko ..... A43B 3/0042 36/127
5,392,537 A 2/1995 Goldberg
5,461,800 A * 10/1995 Luthi ..... A43B 13/181 36/114
5,572,806 A 11/1996 Osawa
5,729,912 A * 3/1998 Gutkowski ..... A43B 3/26 36/93
6,032,387 A 3/2000 Johnson
6,092,309 A 7/2000 Edwards
6,125,556 A * 10/2000 Peckler ..... A43B 5/001 36/127
6,202,326 B1 * 3/2001 Hauglin ..... A43B 5/0415 36/117.2
6,237,255 B1 5/2001 Renaudin et al.
7,100,308 B2 9/2006 Aveni
7,143,530 B2 * 12/2006 Hudson ..... A43B 1/0072 36/128
7,401,422 B1 7/2008 Scholz et al.
7,513,065 B2 4/2009 Kita et al.
8,037,621 B2 10/2011 Hooper
8,117,770 B2 2/2012 Wong
8,151,489 B2 4/2012 Marvin et al.
8,365,444 B2 2/2013 Youngs
8,578,629 B2 11/2013 Bosomworth et al.
8,646,191 B2 2/2014 Amos et al.
9,179,733 B2 * 11/2015 Peyton ..... A43B 5/06
9,241,535 B2 * 1/2016 Baudouin ..... A43B 13/181
9,398,785 B2 * 7/2016 Horacek ..... A43B 3/0036
10,226,097 B2 3/2019 Farris et al.
2001/0007177 A1 7/2001 Brown, Jr. et al.
2005/0000115 A1 1/2005 Kimura et al.
2005/0039350 A1 2/2005 Hung
2006/0117600 A1 * 6/2006 Greene ..... A43B 13/141 36/9 R
2006/0254087 A1 11/2006 Fechter
2007/0039208 A1 2/2007 Bove et al.
2007/0266598 A1 * 11/2007 Pawlus ..... A43B 13/141 36/102
2008/0066348 A1 * 3/2008 O'Brien ..... A43B 5/001 36/100
2008/0263900 A1 10/2008 Determe et al.
2010/0139122 A1 * 6/2010 Zanatta ..... A43B 3/26 36/97
2012/0218397 A1 9/2010 Nishiwaki et al.
2011/0047816 A1 * 3/2011 Nurse ..... A43B 13/14 36/28
2011/0214313 A1 * 9/2011 James ..... A43B 13/141 36/103
2012/0036739 A1 2/2012 Amos et al.
2012/0055047 A1 * 3/2012 Youngs ..... A43B 13/141 36/25 R
2013/0326911 A1 * 12/2013 Baucom ..... A43B 13/122 36/103
2014/0182167 A1 * 7/2014 James ..... A43B 7/1465 36/88
2014/0223778 A1 8/2014 Horacek
2014/0250723 A1 9/2014 Kohatsu
2014/0366401 A1 * 12/2014 Cavaliere ..... A43B 13/14 36/103
2015/0027005 A1 * 1/2015 Lee ..... A43B 7/081 36/102
2015/0047222 A1 * 2/2015 Rushbrook ..... A43B 13/141 36/83
2015/0089841 A1 4/2015 Smaldone et al.
2015/0282557 A1 * 10/2015 Kirk ..... A43B 13/141 36/31
2017/0079374 A1 3/2017 Farris et al.
2017/0079375 A1 3/2017 Bunnell et al.
2017/0079376 A1 3/2017 Bunnell et al.
2017/0079378 A1 3/2017 Farris et al.
2017/0127755 A1 5/2017 Bunnell et al.
2017/0340056 A1 11/2017 Bunnell et al.
2017/0354200 A1 12/2017 Orand et al.
2017/0367439 A1 * 12/2017 Fallon ..... A43B 3/246
2018/0027922 A1 2/2018 Orand
2018/0042338 A1 2/2018 Orand

FOREIGN PATENT DOCUMENTS

DE 102012104264 A1 11/2013
EP 1127504 A2 8/2001
EP 1483981 A1 12/2004
EP 2926678 A2 10/2015
FR 892219 A 3/1944
FR 2974482 A1 11/2012
WO 03075698 A1 9/2003
WO 2006087737 A1 8/2006
WO 2011005728 A1 1/2011

* cited by examiner

SOLE STRUCTURE FOR ARTICLE OF FOOTWEAR HAVING A NONLINEAR BENDING STIFFNESS

CROSS-REFERENCE TO RELATED APPLICATION

The present disclosure claims priority to, and the benefit of, U.S. Provisional Patent Application No. 62/343,427, filed May 31, 2016, the entire disclosure of which is incorporated by reference.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are configured to provide desired cushioning, motion control, and resiliency.

DETAILED DESCRIPTION

Figure 1:
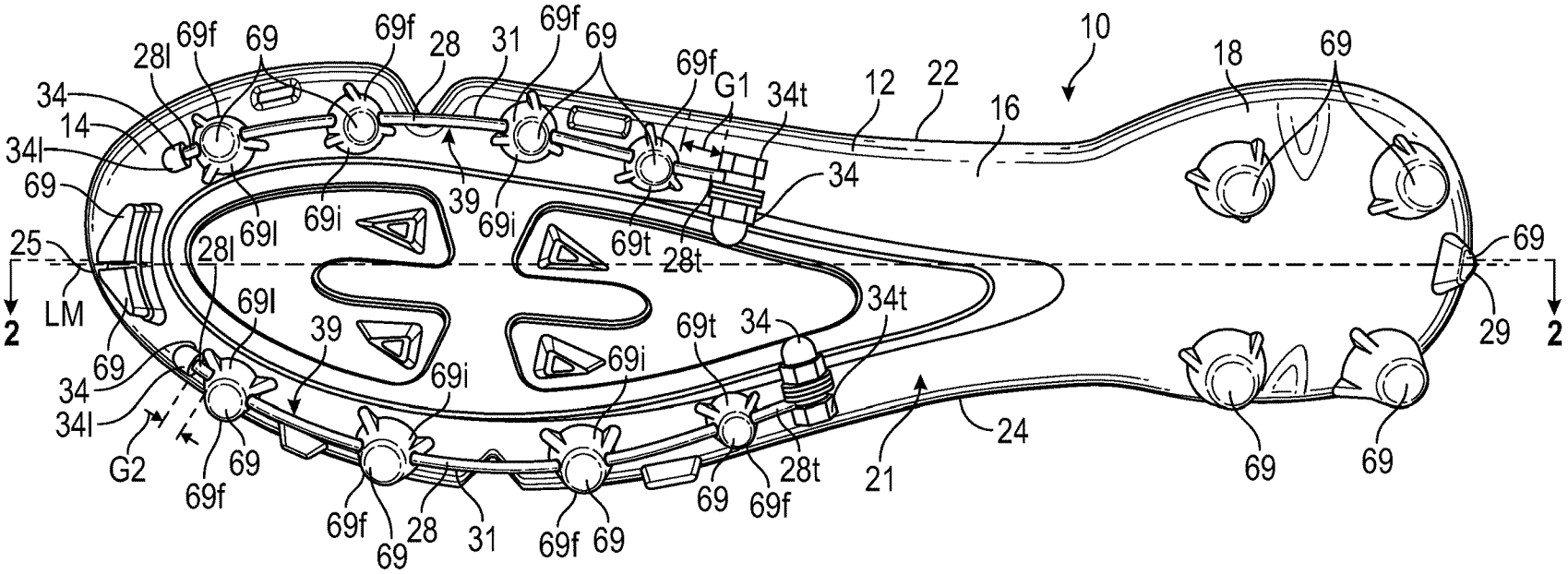
FIG. 1 is a schematic illustration in perspective view of a ground-facing surface of an embodiment of a sole structure for an article of footwear in an unflexed position.

A sole structure for an article of footwear comprises a sole plate, a plurality of traction elements protruding from the sole plate, and a tension member extending through at least one traction element. For example, the tension member may be a cable and may extend through at least some traction elements. The tension member can move through at least some of the traction elements during dorsiflexion of the sole structure in a first flexion range. The tension member interferes with at least some traction elements during dorsiflexion of the sole structure in a second flexion range, which is greater than the first flexion range. The sole plate includes a forefoot portion, and traction elements include forefoot traction elements protruding from the forefoot portion. The tension member may extend only through the forefoot traction elements. The sole structure has a first bending stiffness when the sole structure flexes in the first flexion range. The sole structure has a second bending stiffness when the sole structure flexes in the second flexion range. The second flexion range is greater than the first flexion range. The second bending stiffness is greater than the first bending stiffness.

The sole plate includes a foremost extent and a rearmost extent opposite the foremost extent. The forefoot traction elements include a leading traction element, a trailing traction element, a plurality of intermediate traction elements between the leading traction element and the trailing traction element. The leading traction element is closer to the foremost extent than to the rearmost extent. The rearmost extent is closer to the trailing traction element than to the leading traction element. The tension member extends through the leading traction element, the trailing traction element, and the intermediate traction elements.

The sole structure may further include a leading mechanical stop coupled to the tension member. The leading mechanical stop is in contact with the leading traction element when the sole plate is flexed in the longitudinal direction at flex angles that are greater than or equal to the predetermined flex angle. The sole structure may further include a trailing mechanical stop coupled to the tension member. The trailing mechanical stop is in contact with the trailing traction element when the sole plate is flexed in the longitudinal direction at flex angles greater than or equal to the predetermined flex angle. The leading mechanical stop is spaced apart from the leading traction element when the sole plate is flexed in the longitudinal direction at flex angles that are less than the predetermined flex angle so as to define a first gap between the leading mechanical stop and the leading traction element. The trailing mechanical stop is spaced apart from the trailing traction element when the sole plate is flexed in the longitudinal direction at flex angles that are less than the predetermined flex angle so as to define a second gap between the trailing mechanical stop and the trailing traction element. In some embodiments, the sole plate may at least partially surround the tension member.

In certain embodiments, the sole structure includes a sole plate, a traction element extending from the sole plate, and a tension member coupled to the sole plate. The tension member extends through the traction element and is in tension when the sole plate is flexed in a longitudinal direction at flex angles that are greater than or equal to a predetermined flex angle. The sole plate includes a foremost extent and a rearmost extent opposite the foremost extent, and the traction element is adjacent the foremost extent. The tension member extends through the traction element at two different locations. The traction element has a surface, which faces away from the rearmost extent. The tension member may be a cable that is wrapped around the surface of the traction element. The tension member is anchored at a location spaced apart from the foremost extent and the traction element.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims. The invention illustratively disclosed herein may be practiced in the absence of any element which is not specifically disclosed herein.

Figure 2:
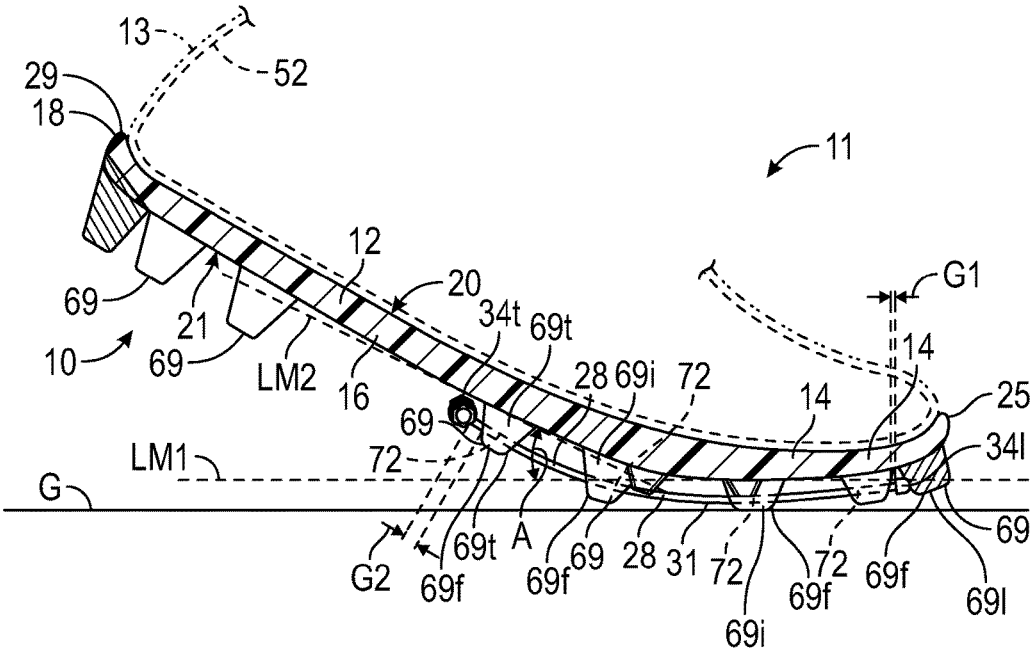
FIG. 2 is a schematic cross-sectional illustration of the sole structure of FIG. 1 taken at lines 2-2 in FIG. 1, flexed in a first portion of a flexion range.

Referring to the drawings, wherein like reference numbers refer to like components throughout the views, FIG. 1 shows a sole structure 10 for an article of footwear 11 shown in FIG. 2. The sole structure 10 has a resistance to flexion that increases with increasing dorsiflexion of the forefoot portion 14 of the sole structure 10 (i.e., flexing of the forefoot portion 14 in the longitudinal direction as discussed herein). As further explained herein, due to a tension member 28 operatively connected to a sole plate 12, the sole structure 10 provides a non-linear increase in bending stiffness when flexed in a longitudinal direction at one or more predetermined flex angles. More particularly, the sole structure 10 has a bending stiffness that is a piecewise function with changes at a predetermined flex angle. The bending stiffness is tuned by the selection of various structural parameters discussed herein that determine the predetermined flex angle. As used herein, "bending stiffness" means the resistance of a member (e.g., the sole structure 10) against bending deformation and may be used interchangeably with "bend stiffness."

Referring to FIGS. 1-4, the sole structure 10 includes a sole plate 12, and may include one or more additional plates, layers, or components, as discussed herein. The sole structure 10 is secured to the upper 13 and has a configuration that extends between the upper 13 and the ground G (included in FIG. 3). The sole plate 12 is configured to be operatively connected to the upper 13 as discussed herein. The upper 13 may incorporate a plurality of material elements (e.g., textiles, foam, leather, and synthetic leather) that are stitched or adhesively bonded together to form an interior void for securely and comfortably receiving a foot 52 as shown. The material elements may be selected and located with respect to upper 13 in order to selectively impart properties of durability, air-permeability, wear-resistance, flexibility, and comfort, for example. An ankle opening provides access to the interior void. In addition, the upper 13 may include a lace or other tightening mechanism that is utilized to modify the dimensions of the interior void, thereby securing the foot 52 within the interior void and facilitating entry and removal of the foot 52 from the interior void. For example, a lace may extend through apertures in upper 13, and a tongue portion of upper 13 may extend between the interior void and the lace. The upper 13 may exhibit the general configuration discussed above or a different configuration. Accordingly, the structure of the upper 13 may vary significantly within the scope of the present teachings.

The sole structure 10 includes the sole plate 12 and, in some embodiments includes other layers and components. The sole structure 10 is secured to the upper 13 and has a configuration that extends between the upper 13 and the ground G. The sole plate 12 may or may not be directly secured to the upper 13. In addition to attenuating ground reaction forces (i.e., providing cushioning for the foot), the sole structure 10 may provide traction, impart stability, and limit various foot motions.

In the embodiment shown, the sole plate 12 is a full-length, unitary sole plate 12 that has a forefoot portion 14, a midfoot portion 16, and a heel portion 18. The sole plate 12 provides a foot-receiving surface 20 (also referred to as a foot-facing surface) that extends over the forefoot portion 14, the midfoot portion 16, and the heel portion 18. The foot-facing surface 20 supports the foot 52 but need not be in contact with the foot 52. For example, an insole, midsole, strobel, or other layers or components may be positioned between the foot 52 and the foot-facing surface 20.

The sole plate 12 extends from a medial side 22 to a lateral side 24. In other embodiments, the sole plate 12 may be a partial length plate member. For example, in some cases, the sole plate 12 may include only a forefoot portion that may be operatively connected to other components of the article of footwear that comprise a midfoot portion and a heel portion. As shown, the sole plate 12 extends from the lateral side 24 to the medial side 22. As used herein, a lateral side of a component for an article of footwear, including the lateral side 24 of the sole plate 12, is a side that corresponds with an outside area of the human foot 52 (i.e., the side closer to the fifth toe of the wearer). The fifth toe is commonly referred to as the little toe. A medial side of a component for an article of footwear, including the medial side 22 of the sole plate 12, is the side that corresponds with an inside area of the human foot 52 (i.e., the side closer to the hallux of the foot of the wearer). The hallux is commonly referred to as the big toe. Both the lateral side 24 and the medial side 22 extend from a foremost extent 25 to a rearmost extent 29 of a periphery of the sole plate 12.

The term "longitudinal," as used herein, refers to a direction extending along a length of the sole structure 10, e.g., extending from the forefoot portion 14 to the heel portion 18 of the sole structure 10. The term "forward" is used to refer to the general direction from the heel portion 18 toward the forefoot portion 14, and the term "rearward" is used to refer to the opposite direction, i.e., the direction from the forefoot portion 14 toward the heel portion 18. The term "anterior" is used to refer to a front or forward component or portion of a component. The term "posterior" is used to refer to a rear or rearward component or portion of a component.

The heel portion 18 generally includes portions of the sole plate 12 corresponding with rear portions of a human foot, including the calcaneus bone, when the human foot is supported on the sole structure 10 and is a size corresponding with the sole structure 10. The forefoot portion 14 generally includes portions of the sole plate 12 corresponding with the toes and the joints connecting the metatarsal bones with the phalange bones of the human foot (interchangeably referred to herein as the "metatarsal-phalangeal joints" or "MPJ" joints). The midfoot portion 16 generally includes portions of the sole plate 12 corresponding with an arch area of the human foot, including the navicular joint. Portions 14, 16, 18 are not intended to demarcate precise areas of the sole structure 10. Rather, portions 14, 16, 18 are intended to represent general areas relative to one another, to aid in the following discussion. In addition to the sole structure 10, the portions 14, 16, 18, and medial and lateral sides 22, 24 may also be applied to the upper 13, the article of footwear 11, and individual components thereof.

The sole plate 12 is referred to as a plate, but is not necessarily flat and need not be a single component but instead can be multiple interconnected components. For example, both an upward-facing portion of the foot-facing surface 20 and the opposite ground-facing surface 21 may be pre-formed with some amount of curvature and variations in thickness when molded or otherwise formed in order to provide a shaped footbed and/or increased thickness for reinforcement in desired areas. For example, the sole plate 12 could have a curved or contoured geometry that may be similar to the lower contours of the foot 52. For example, the sole plate 12 may have a contoured periphery that slopes upward toward any overlaying layers, such as a midsole component or the upper 13.

The sole plate 12 may be entirely of a single, uniform material, or may have different portions comprising different materials. For example, a first material of the forefoot portion 14 can be selected to achieve, in conjunction with the tension member 28 and other features and components of the sole structure 12 discussed herein, the desired bending stiffness in the forefoot portion 14, while a second material of the midfoot portion 16 and the heel portion 18 can be a different material that has little effect on the bending stiffness of the forefoot portion 14. By way of non-limiting example, the second portion can be over-molded onto or co-injection molded with the first portion. Example materials for the sole plate 12 include durable, wear resistant materials such as but not limited to nylon, thermoplastic polyurethane, or carbon fiber.

In the embodiment shown, the sole plate 12 may be an inner board plate, also referred to as an inner board, an insole board, or a lasting board. In other embodiments, the sole plate 12 may be an outsole. Still further, the sole plate 12 could be a midsole plate or a unisole plate, or may be any combination of an inner board plate, a midsole plate, or an outsole.

The sole structure 10 includes traction elements 69, such as cleats or spikes. The traction elements 69 may be integrally formed as part of the sole plate 12 (e.g., if the sole plate is an outsole or a unisole plate), may be attached to the sole plate 12, or may be formed with or attached to another plate underlying the sole plate 12, such as if the sole plate 12 is an inner board plate and the sole structure 10 includes an underlying outsole. For example, the traction elements 69 may be integrally formed cleats. In other embodiments, the traction elements 69 may be, for example, removable spikes. The traction elements 69 protrude below the ground-facing surface 21 of the sole plate 12. Direct ground reaction forces on the sole plate 12 that could affect the operation of the tension member 28 are thus minimized. The traction elements 69 include forefoot traction elements **69*f* protruding from the forefoot portion 14. The forefoot traction elements 69*f* include leading traction elements 69*l*, trailing traction element 69*t*, and intermediate traction elements 69*i* between the leading traction elements 69*l* and the trailing traction element 69*t*. The leading traction elements 69*l* are closer to the foremost extent 25 than to the rearmost extent 29. The rearmost extent 29 is closer to the trailing traction elements 69*t* than to the leading traction elements 69*l*. All the forefoot traction elements 69*f* are closer to the foremost extent 25 than to the rearmost extent 29 of the sole plate 12**.

The sole structure 10 can bend in dorsiflexion in response to forces applied by corresponding bending of a user's foot at the MPJ during physical activity. During this dorsiflexion, at least a portion of the forefoot portion 14 of the sole structure 10 flexes relative to the heel portion 18. This flexion can be measured by a flex angle A. In the present disclosure, the term "flex angle" is defined as the angle formed at the intersection between a first axis LM1 and a second axis LM2, where the first axis LM1 generally extends along a longitudinal midline LM (FIG. 1) at a ground-facing surface 21 of sole plate 12 anterior to the trailing traction element **69*t*, and the second axis LM2 generally extends along the longitudinal midline LM at the ground-facing surface 21 of the sole plate 12 posterior to the intermediate traction element 69*i***.

The sole structure 10 has at least one tension member 28 operatively secured to at least some traction elements 69. As used herein, a tension member is "operatively secured" to the traction elements when the tension member is directly or indirectly attached to the traction elements 69. The tension member 28 extends through at least some of the traction elements 69. In the depicted embodiment, the tension member 28 is cable 31, which may have a generally circular cross-section. The tension member 28 may be a variety of materials including metal, a polymeric material, a composite, or fabric. In the depicted embodiment, the sole structure 10 includes only two tension members 28, but is it envisioned that the sole structure 10 may include more or fewer tension members 28.

Each tension member 28 is part of a tension assembly 39 configured to increase the bending stiffness of the forefoot portion 14 of the sole plate 12 during dorsiflexion of the sole structure 10, as discussed in detail below. In the depicted embodiment, the sole structure 10 includes two tension assemblies assembly 39; however, the sole structure 10 may include more or fewer tension assemblies 39. Regardless of the quantity, each tension assembly 39 includes at least one tension member 28 and at least one mechanical stop 34 coupled to the tension member 28. As a non-limiting example, the mechanical stops 34 can be a solid or hollow body, such as a pin or a ball, configured to abut at least one of the traction elements 69 in order to limit the movement of the tension member 28 relative to the traction elements 69. In the depicted embodiment, each tension assembly 39 includes one mechanical stop 34 (i.e., the first or trailing mechanical stop **34*t*) coupled to a first or trailing end 28*t* of the tension member 28*t*, and another mechanical stop (i.e., the second or leading mechanical stop 34*l*) coupled to a leading or second end 28*l* of the tension member 28**.

Each tension member 28 extends through at least some of the plurality of traction elements 69. In an embodiment, the term "at least some of the plurality of traction elements" refers to two or more traction elements 69. For example, in an embodiment, each tension member 28 extends through four traction elements 69. In the depicted embodiment, each tension member 28 extends only through the forefoot traction elements 69*f* protruding from the forefoot portion 14 of the sole structure 10. Specifically, the tension member 28 extends through the leading traction elements 69*l*, trailing traction element 69*t*, and intermediate traction elements 69*i*. The forefoot traction elements 69*f* defines channels 72 configured, shaped, and sized to slidably receive the tension member 28. The mechanical stops 34, on the other hand, are larger than the channels 72 and, therefore, the channels 72 cannot receive the mechanical stops 34.

Figure 4:
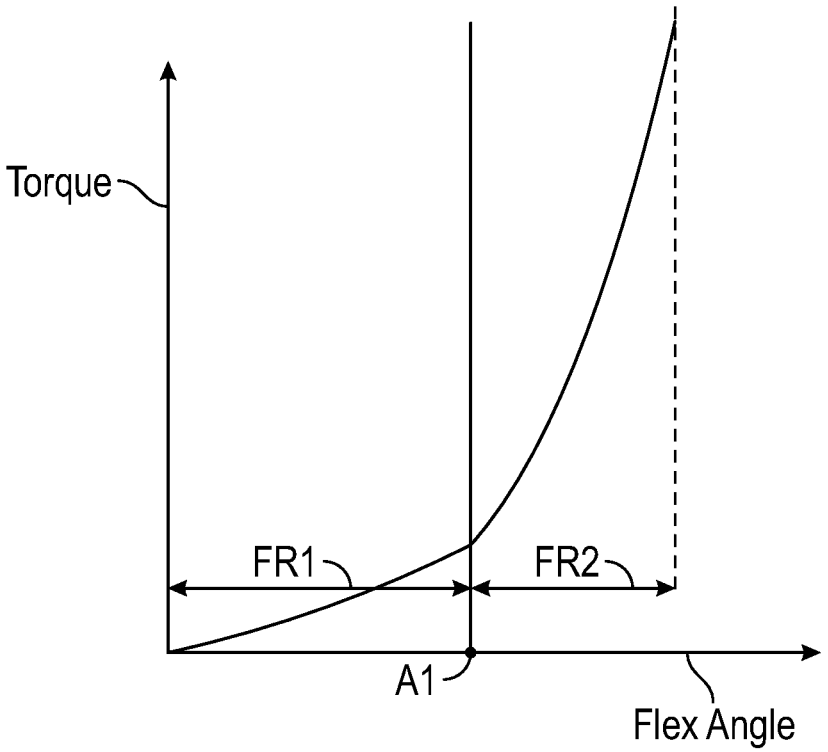
FIG. 4 is a plot of torque versus flex angle for the sole structure of FIGS. 1-3.

Because the tension member 28 is slidably disposed in the channels 72, the tension member 28 can move (e.g., slide) relative to the traction elements 69 while the forefoot portion 14 is in dorsiflexion of the sole structure 10 in a first flexion range (as shown in FIG. 4). The first flexion range includes flex angles A that are less than a predetermined flexion angle A1 (as shown in FIG. 4). Thus, when the sole plate 12 is dorsiflexed in the first flexion range FR1 as shown in FIG. 2, the tension member 28 simply slides through the traction elements 69. Moreover, when the sole plate 12 is dorsiflexed in the first flexion range FR1, the leading mechanical stops 34*l* are spaced apart from the leading traction elements 69*l*, thereby defining a gap (i.e., the first gap G1) between the leading traction elements 69*l* and the leading mechanical stop 34*l*. Similarly, the trailing mechanical stops 34*t* are spaced apart from the trailing traction elements 69*t*, thereby defining a gap (i.e., the second gap G2) between the trailing traction elements 69*t* and the trailing mechanical stop 34*t* when the sole plate 12 is dorsiflexed in the first flexion range FR1. Therefore, while the sole plate 12 is dorsiflexed in the first flexion range FR1, the sole plate 12 bends freely and relatively unconstrained by the tension member 28, and the tension member 28 is relatively slack. Although the tension member 28 is slack when the sole plate 12 is disposed at flex angles that are less than the predetermined flex angle A1 (e.g., in a relaxed, unflexed state or flexed at a flex angle within the first flexion range FR1), some amount of negligible friction may be generated between the tension member 28 and the traction elements 69.

Figure 3:
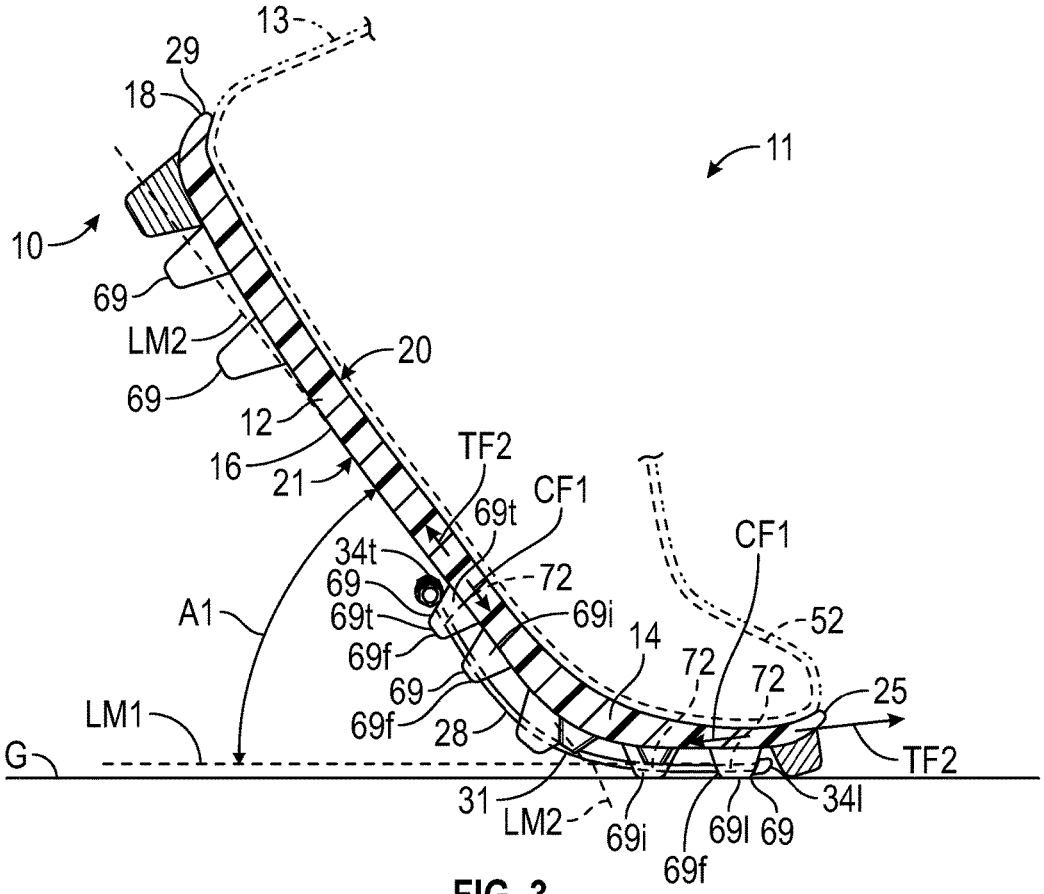
FIG. 3 is a schematic cross-sectional illustration of the sole structure of FIG. 1 taken at lines 2-2 in FIG. 1, at a predetermined flex angle.

Additional dorsiflexion of the sole plate 12 can cause the forefoot portion 14 of the sole structure 12 to flex beyond the predetermined flex angle A1 as shown in FIG. 3. The predetermined flex angle A1 is the beginning of a second flexion range FR2. Thus, the second flexion range FR2 includes flex angles that are greater than the predetermined flex angle A1. By way of non-limiting example, the predetermined flex angle A1 may be from about 30 degrees to about 65 degrees. In one exemplary embodiment, the predetermined flex angle A1 is found in the range of between about 30 degrees and about 60 degrees, with a typical value of about 55 degrees. In another exemplary embodiment, the predetermined flex angle A1 is found in the range of between about 15 degrees and about 30 degrees, with a typical value of about 25 degrees. In another example, the predetermined flex angle A1 is found in the range of between about 20 degrees and about 40 degrees, with a typical value of about 30 degrees.

When the sole plate 12 dorsiflexes at the predetermined flex angle A1 as shown in FIG. 3, the leading mechanical stops 34*l* abut the leading traction elements 69*l*, and the trailing mechanical stops 34*t* abut the trailing traction element 69*t*, causing the tension member 28 to be in tension. As a consequence, the tension member 28 can no longer slide through the traction elements 69. Because the leading mechanical stops 34*l* remain in abutment with the leading traction elements 69*l*, and the trailing mechanical stops 34*t* remain in abutment with the trailing traction element 69*t* when the sole plate 12 dorsiflexes in the second flexion range FR2, further dorsiflexion of the sole structure 10 (i.e., beyond the predetermined flex angle A1) places the tension member 28 under increased tension, causing a corresponding increase in resistance to flexion and bending stiffness of the sole structure 10. Accordingly, the tension in the tension member 28 when the sole plate 12 is dorsiflexed in the second flexion range FR2 is greater than the tension in the tension member 28 when the sole plate 12 is dorsiflexed in the first flexion range FR1.

The sole structure 10 will bend in dorsiflexion in response to forces applied by corresponding bending of a user's foot at the MPJ during physical activity. Throughout the first portion of the flexion range FR1, bending stiffness will increase progressively as bending progresses through increasing angles of flexion. Because bending within the first flexion range FR1 is primarily governed by inherent material properties of the materials of the sole plate 12 and the tension member 28, a graph relating angle of flexion to bend stiffness in the first portion of the flexion range FR1 will typically demonstrate a smoothly but relatively gradually inclining curve (referred to herein as a "linear" increase in bend stiffness). The tension member 28 is under no tension, or minimal tension such as due to friction between the traction elements 69 and the tension member 28, in the first flexion range FR1. At the boundary between the first and second flexion ranges FR1, FR2, however, the abutment of the mechanical stops 34 with the traction element 69 engages additional material and mechanical properties that exert a notable increase in resistance to further dorsiflexion (i.e., the tension member 28 is placed under markedly increased tension).

Therefore, a corresponding graph of torque versus angle of deflection (the slope of which is the bending stiffness) that also includes the second flexion range FR2 would show—beginning at an angle of flexion approximately corresponding to angle A1—a departure from the gradually and smoothly inclining curve characteristic of the first portion of the flexion range FR1. This departure is referred to herein as a "non-linear" increase in bend stiffness, and would manifest as either or both of a stepwise increase in bending stiffness and/or a change in the rate of increase in the bending stiffness. The change in rate can be either abrupt, or it can manifest over a short range of increase in the bend angle of the sole structure 10. In either case, a mathematical function describing a bending stiffness in the second flexion range FR2 will differ from a mathematical function describing bending stiffness in the first portion of the flexion range. FIG. 4 is an example plot depicting an expected increase in resistance to flexion at increasing flex angles, as exhibited by the increasing magnitude of torque required at the heel portion 18 for dorsiflexion of the forefoot portion 14. The bending stiffness in the first flexion range FR1 may be constant (thus the plot would have a linear slope) or substantially linear or may increase gradually (which would show a change in slope in FR1). The bending stiffness in the second flexion range FR2 may be linear or non-linear, but will depart from the bending stiffness of the first flexion range FR1 at the first predetermined flex angle A1, either markedly or gradually (such as over a range of several degrees) at the first predetermined flex angle A1 due to the abutment of the mechanical stops 34 with at least some of the traction elements 69.

Functionally, when the sole plate 12 is dorsiflexed as shown in FIG. 3, the tension member 28 simply slides through the traction elements 69. During this first portion of the flexion range, the sole plate 12 bends freely and relatively unconstrained by the tension member 28, and the tension member 28 is relatively slack. When the flex angle of the sole structure 10 reaches the predetermined flex angle A1, longitudinally opposing compressive forces directed inwardly upon the sole plate 12 can no longer be relieved by the sole plate 12 bending outwardly toward the tension member 28 without placing the tension member 28 under tension, as they could throughout the first flexion range FR1. Instead, further bending of the sole 12 plate is additionally constrained by the tension member's 28 resistance to elongation in response to the progressively increasing tensile forces applied along its long axis, and by the sole plate's 12 resistance to compressive shortening and deformation in response to the compressive forces applied along its longitudinal axis. Accordingly, the tensile and compressive characteristics of the material(s) of the tension member 28 and sole plate 12, respectively, play a large role in determining a change in bending stiffness of the sole structure 10 as it transitions from the first portion of the flexion range FR1, to and through the second portion of the flexion range FR2.

With reference to FIGS. 2-4, as the foot 52 flexes by lifting the heel portion 18 away from the ground G while maintaining contact with the ground G at a forefoot portion 14 of the article of footwear 11 corresponding with a forward portion of the forefoot portion 14, it places torque on the sole structure 10 and causes the sole plate 12 to flex at the forefoot portion 14.

During bending of the sole plate 12 as the foot 52 is dorsiflexed, there is a layer in the sole plate 12 referred to as a neutral plane (although not necessarily planar) or a neutral axis above which the sole plate 12 is in compression, and below which the sole plate 12 is in tension. The interference of the tension member 28 with the mechanical stops 34 while abutting at least some of the plurality of traction elements 69 places the tension member 28 in tension and causes additional compressive forces CF1 on the sole plate 12 above the neutral plane, and additional tensile forces TF2 below the neutral plane, nearer the ground-facing surface 21. In an embodiment, the term "at least some of the plurality of traction elements" refers to two or more traction elements 69. For example, during dorsiflexion of the sole structure 10 in the second flexion range FR2, the tension member 28 interferes (via the mechanical stops 34) with two traction elements 69.

In addition to the mechanical (e.g., tensile, compression, etc.) properties of the selected material of the sole plate 12 and the tension member 28, structural factors that likewise affect changes in bend stiffness during dorsiflexion include but are not limited to the thicknesses, the longitudinal lengths, and the medial-lateral widths of the sole plate 12, and the tension member 28.

Figure 5:
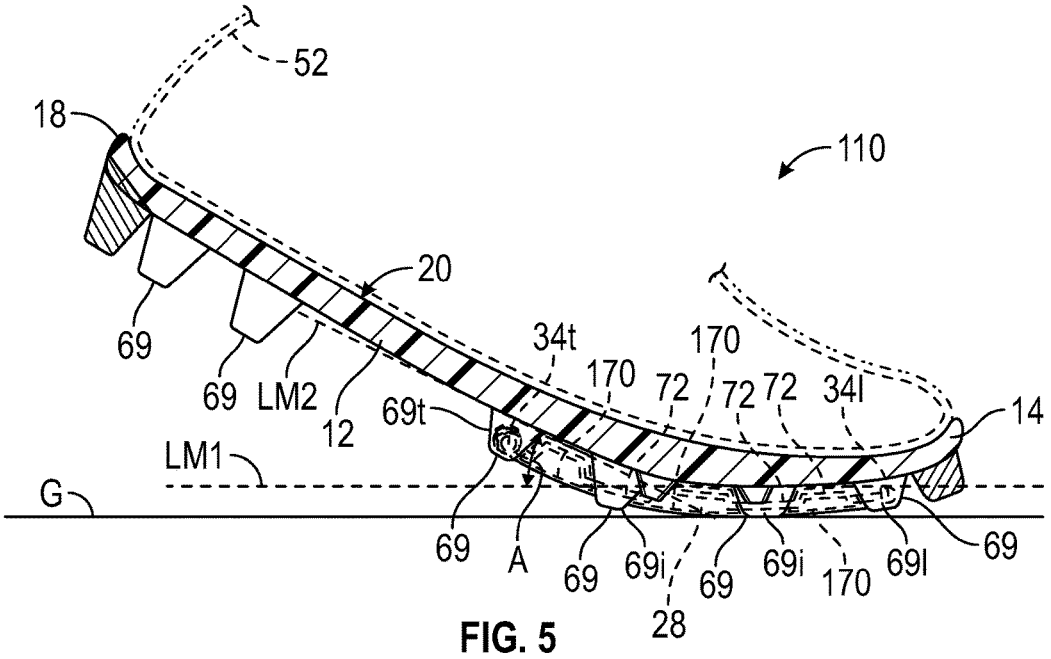
FIG. 5 is a schematic cross-sectional illustration of an alternative embodiment of a sole structure for an article of footwear, flexed in a first portion of a flexion range.
Figure 6:
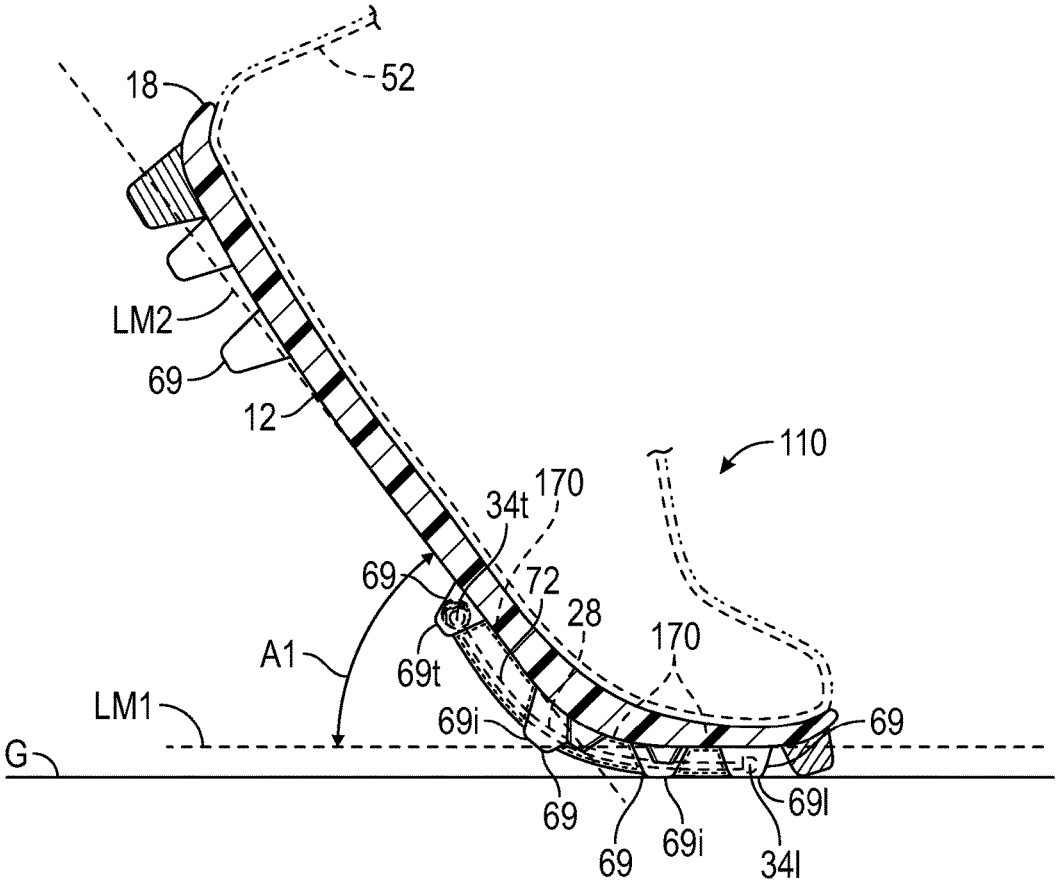
FIG. 6 is a schematic cross-sectional illustration of the alternative embodiment of the sole structure of FIG. 5, flexed at a predetermined flex angle.

FIGS. 5 and 6 illustrate an alternative embodiment of a sole structure 110. The structure and operation of the sole structure 110 is similar to the structure and operation of the sole structure 10 shown in FIG. 1. Thus, in the interest of brevity, the description below focuses on the differences between the sole structure 10 and the sole structure 110. Like or the same reference numbers in FIGS. 1-6 refer to like and/or the same components. In the depicted embodiment, the tension member 28 is partly or entirely disposed within the sole plate 12. As a non-limiting example, the sole plate 12 can be molded over the tension member 28. Further, the mechanical stop 34*t* is partly or entirely disposed inside the trailing traction element 34*t*, and the mechanical stop 34*l* is partly or entirely disposed inside the leading traction element 34*l*. Alternatively or additionally, the trailing end 28*t* of the tension member 28 is anchored within the trailing traction element 69*t*, and the leading end 28*l* of the tension member 28 may be anchored within the leading traction element 69*l*. The tension member 28 may be anchored to the leading and trailing traction elements 69*l*, 69*t* using any suitable methods, such as fasteners.

The sole plate 12 has a plurality of inner cavities 170 each disposed between the traction elements 69. Each inner cavity 170 is configured, shaped, and sized to receive portions of the tension member 28. In particular, each cavity 170 can accommodate the tension member 28 regardless of whether the tension member 28 is slack (as shown in FIG. 5) or in tension (as shown in FIG. 6). Therefore, the tension member 28 not only can slide through the channels 72 defined through the traction elements 69, but the tension member 28 can also move within the inner cavities 170 during dorsiflexion of the sole structure 110. The tension member 28 is slack when the sole plate 12 is disposed at flex angles that are less than the first predetermined flex angle A1 (e.g., in a relaxed, unflexed state or flexed at a flex angle within the first flexion range FR1) in. Further, the tension member 28 is in tension when the sole plate 12 flexes in the second flex range FR2 (i.e., flex angles greater than the predetermined flex angle A1), thereby increasing the bending stiffness of the sole structure 110 as discussed above.

Figure 7:
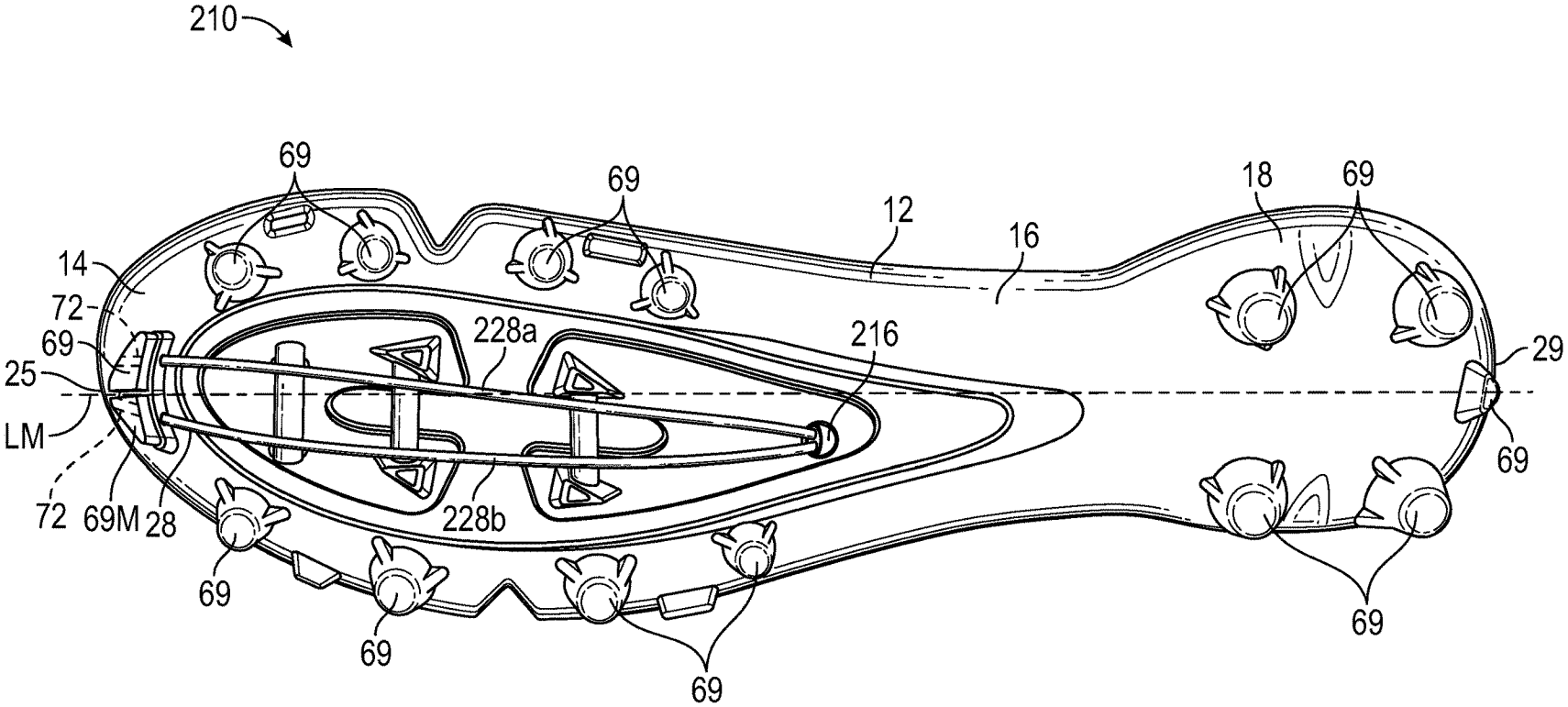
FIG. 7 is a schematic illustration in perspective view of a ground-facing surface of the sole structure of FIG. 6 in an unflexed position.
Figure 8:
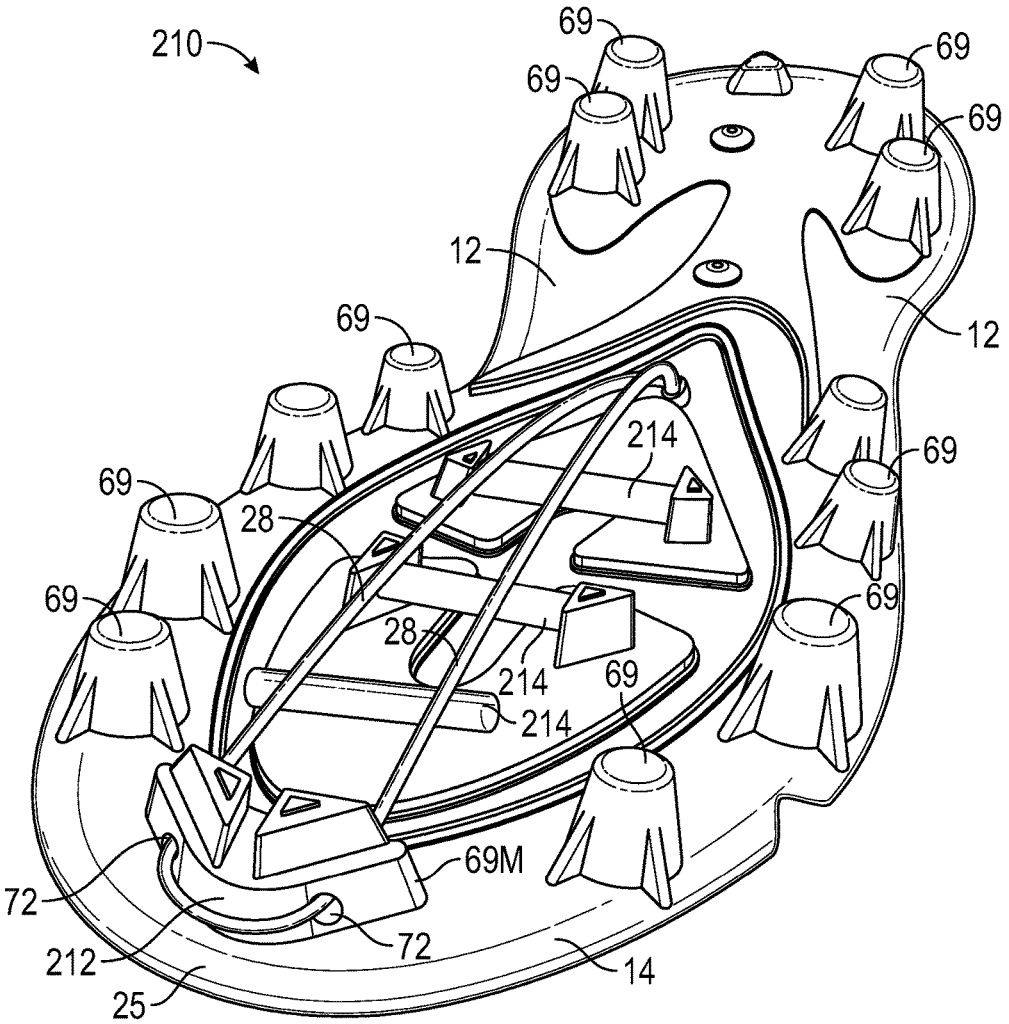
FIG. 8 is another schematic illustration in perspective view of a ground-facing surface of an alternative embodiment of a sole structure for an article of footwear in an unflexed position.

FIGS. 7 and 8 illustrate an alternative embodiment of a sole structure 210. The structure and operation of the sole structure 210 is similar to she structure and operation of the sole structure 10 shown in FIG. 1 and FIG. 5. Thus, in the interest of brevity, the description below focuses on the differences between the sole structure 10 and the sole structure 210. Like or the same reference numbers in FIGS. 1-8 refer to like and/or the same components. In the depicted embodiment, the tension member 28 extends only through the traction element 69 that is closest to the foremost extent 25 of the sole plate 12. The traction element 69 that is closest to the foremost extent 25 is referred to as the foremost traction element 69M. In the depicted embodiment, the tension member 28 extends only through the foremost traction element 69M. It is contemplated, however, that the tension member 28 may extend through other traction elements 69.

The foremost traction element 69M has at least one channel 72 configured, shaped, and sized to receive the tension member 28. For example, the foremost traction element 69M may have at least two channels 72 in order to allow the tension member 28 to extend through the foremost traction element 69M at two different locations. The foremost traction element 69M has a surface 212 facing away from the rearmost extent 29. The tension member 28 extends through two different locations of the foremost traction element 69M and is wrapped around the surface 212, thereby allowing at least a portion of the tension member 28 to slide along the surface 212 during dorsiflexion of the sole structure 210. Two separate portions 228*a*, 228*b* of the tension member 28 extend from the channels 72 toward the rearmost extent 29 and may rest on rollers 214 in order to facilitate movement of the tension member 28 relative to the sole plate 12. Each roller 214 is coupled to the sole plate 12 between two traction elements 69. The two separate portions 228*a*, 228*b* of the tension member 28 are fixed to the sole plate 12 by a fastener 216. The tension member 28 is slack when the sole plate 12 is disposed at flex angles that are less than the predetermined flex angle A1 (e.g., in a relaxed, unflexed state or flexed at a flex angle within the first flexion range FR1). Further, the tension member 28 is in tension when the sole plate 12 flexes in the second flex range FR2

(i.e., flex angles greater than the predetermined flex angle A1), thereby increasing the bending stiffness of the sole structure 110 as discussed above.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:

a sole plate including a forefoot portion, wherein the sole plate defines a plurality of flex angles during dorsiflexion of the sole structure, and wherein the plurality of flex angles includes flex angles that are greater than or equal to a predetermined flex angle, and flex angles that are less than the predetermined flex angle;

a plurality of traction elements protruding from the sole plate;

a tension member extending through at least some of the plurality of traction elements, wherein the tension member is movable through the at least some of the plurality of traction elements during the dorsiflexion of the sole structure; and a leading mechanical stop coupled to the tension member;

wherein the plurality of traction elements includes forefoot traction elements protruding from the forefoot portion;

wherein the forefoot traction elements include a leading traction element;

wherein the leading mechanical stop is in contact with the leading traction element when the sole plate is flexed at the flex angles that are greater than or equal to the predetermined flex angle;

wherein the leading mechanical stop is spaced apart from the leading traction element when the sole plate is flexed at the flex angles that are less than the predetermined flex angle so as to define a gap between the leading mechanical stop and the leading traction element.

2. The sole structure of claim 1, wherein the sole structure has a first bending stiffness when the sole plate is flexed at the flex angles that are less than the predetermined flex angle, the sole structure has a second bending stiffness when the sole plate is flexed at the flex angles that are greater than or equal to the predetermined flex angle, and the second bending stiffness is greater than the first bending stiffness.

3. The sole structure of claim 1, wherein the tension member is slack when the sole plate is disposed at the flex angles that are less than the predetermined flex angle.

4. The sole structure of claim 1, wherein the tension member extends only through the forefoot traction elements.

5. The sole structure of claim 4, wherein the sole plate extends from a foremost extent to a rearmost extent opposite the foremost extent, and the forefoot traction elements include a trailing traction element and a plurality of intermediate traction elements between the leading traction element and the trailing traction element, and wherein the leading traction element is closer to the foremost extent than to the rearmost extent, the rearmost extent is closer to the trailing traction element than to the leading traction element, and the tension member extends through the leading traction element.

6. The sole structure of claim 5, wherein the tension member extends through the trailing traction element.

7. The sole structure of claim 5, wherein the tension member extends through the intermediate traction elements.

8. The sole structure of claim 5, further comprising a trailing mechanical stop coupled to the tension member, wherein the trailing mechanical stop is in contact with the trailing traction element when the sole plate is flexed at the flex angles that are greater than or equal to the predetermined flex angle.

9. The sole structure of claim 8, wherein the gap is a first gap, and the trailing mechanical stop is spaced apart from the trailing traction element when the sole plate is flexed in a longitudinal direction at the flex angles that are less than the predetermined flex angle so as to define a second gap between the trailing mechanical stop and the trailing traction element.

10. The sole structure of claim 1, wherein the at least some of the plurality of traction elements have channels, and the tension member is at least partly received in one or more of the channels.

11. The sole structure of claim 1, wherein the tension member is a cable.

12. The sole structure of claim 1, wherein the traction elements are cleats.

13. A sole structure for an article of footwear comprising:

a sole plate including a forefoot portion, wherein the sole plate defines a plurality of flex angles during dorsiflexion of the sole structure, and wherein the plurality of flex angles includes flex angles that are greater than or equal to a predetermined flex angle, and flex angles that are less than the predetermined flex angle;

at least one traction element protruding from the sole plate;

a tension member coupled to the sole plate, wherein the tension member extends through the at least one traction element, wherein the tension member is movable through the at least one traction element during the dorsiflexion of the sole structure; and a leading mechanical stop coupled to the tension member;

wherein the at least one traction elements includes forefoot traction elements protruding from the forefoot portion;

wherein the forefoot traction elements include a leading traction element;

wherein the leading mechanical stop is in contact with the leading traction element when the sole plate is flexed at the flex angles that are greater than or equal to the predetermined flex angle;

wherein the leading mechanical stop is spaced apart from the leading traction element when the sole plate is flexed at the flex angles that are less than the predetermined flex angle so as to define a gap between the leading mechanical stop and the leading traction element.

14. The sole structure of claim 13, wherein the sole structure has a first bending stiffness when the sole plate is flexed at the flex angles that are less than the predetermined flex angle, the sole structure has a second bending stiffness when the sole plate is flexed at the flex angles that are greater than or equal to the predetermined flex angle, and the second bending stiffness is greater than the first bending stiffness.

15. The sole structure of claim 13, wherein the tension member is slack when the sole plate is flexed at the flex angles that are less than the predetermined flex angle.

16. The sole structure of claim 13, wherein the tension member extends only through the forefoot traction elements.

17. The sole structure of claim 16, wherein the sole plate extends from a foremost extent to a rearmost extent opposite the foremost extent, and the forefoot traction elements include a trailing traction element and a plurality of intermediate traction elements between the leading traction element and the trailing traction element, and wherein the leading traction element is closer to the foremost extent than to the rearmost extent, the rearmost extent is closer to the trailing traction element than to the leading traction element, and the tension member extends through the leading traction element.

18. The sole structure of claim 17, wherein the tension member extends through the trailing traction element.

19. The sole structure of claim 17, wherein the tension member extends through the intermediate traction elements.

20. The sole structure of claim 17, further comprising a trailing mechanical stop coupled to the tension member, wherein the trailing mechanical stop is in contact with the trailing traction element when the sole plate is flexed in a longitudinal direction at the flex angles greater than or equal to the predetermined flex angle.

21. The sole structure of claim 20, wherein the gap is a first gap, the trailing mechanical stop is spaced apart from the trailing traction element when the sole plate is flexed in the longitudinal direction at the flex angles that are less than the predetermined flex angle so as to define a second gap between the trailing mechanical stop and the trailing traction element.

22. The sole structure of claim 13, wherein the tension member is a cable.

23. The sole structure of claim 13, wherein the at least one traction element is a cleat.

* * * * *